United States Patent [19]

French

[11] 4,120,430

[45] Oct. 17, 1978

[54] PUMP DISPENSING PACKAGE

[75] Inventor: Floyd R. French, Kentwood, Mich.

[73] Assignee: The Dow Chemical Company, Midland, Mich.

[21] Appl. No.: 834,606

[22] Filed: Sep. 19, 1977

[51] Int. Cl.[2] ..... B05B 9/04

[52] U.S. Cl. ..... 222/324; 222/383

[58] Field of Search ..... 222/465, 470, 472, 473, 222/474, 469, 324, 323, 383, 385, 79, 210, 209, 206, 402.15; 215/1 C

[56] References Cited

U.S. PATENT DOCUMENTS

| | | | |
|---|---|---|---|
| 2,351,376 | 6/1944 | Ward | 222/472 X |
| 3,233,783 | 2/1966 | Thornton | 222/473 X |
| 3,770,206 | 11/1973 | Tada | 222/385 X |
| 3,797,749 | 3/1974 | Tada | 222/383 X |
| 3,913,841 | 10/1975 | Tada | 222/324 X |

*Primary Examiner*—Stanley H. Tollberg
*Assistant Examiner*—John P. Shannon
*Attorney, Agent, or Firm*—Burke M. Halldorson

[57] ABSTRACT

A plastic bottle is formed with a relatively slim, handle-like extension, which is pivotally and flexibly joined to the bottle, and that serves as an actuator for a spray pump or pump dispenser mounted on the bottle. The actuator is positioned from the bottle a distance such that the bottle forms a back hand rest, with the fingers extended to grip the actuator, and thus permit powerful stroking of the pump dispenser.

2 Claims, 1 Drawing Figure

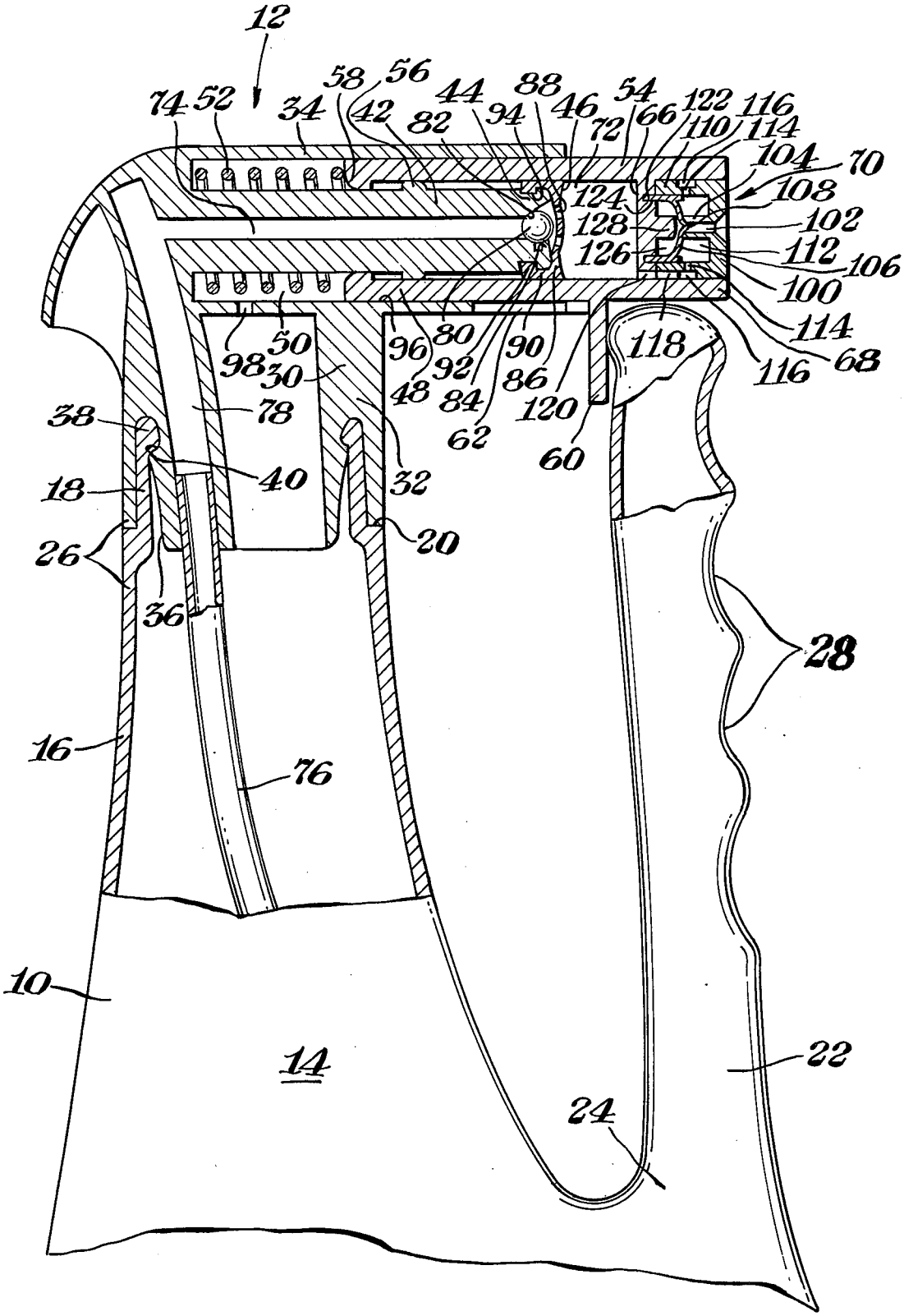
12
74
52
34
58
56
42
82
44
94
88
46
72
54
66
122
110
116
114
104
70
108
124
128
126
102
112
106
100
114
68
116
118
50
98
30
96
80
92
48
84
62
90
86
120
60
38
78
40
32
18
20
26
36
28
16
76
10
14
22
24

PUMP DISPENSING PACKAGE

FIELD OF THE INVENTION

The invention generally relates to pump dispensers. More particularly, the invention relates to the combination of a pump and blown bottle, wherein the actuator for the pump is an integral and thus inexpensive part of the bottle construction.

BACKGROUND OF THE INVENTION

Maximum brevity and economy are especially important criteria in the design of a hand spray pump or pump dispenser. It is particularly desirable also that the mechanics of the pump do not require excessive labor by the user. Thus, an inexpensive, leveraged actuator permitting the gripping force of the entire hand to operate the pump would be especially advantageous.

These and other objectives of the invention are uniquely achieved using the combination of an actuator integrally formed in a blown plastic bottle, the actuator being pivotally and flexibly joined to the bottle and spaced therefrom a distance such that the bottle defines a back hand rest, with the fingers extended to grip the actuator, and wherein the actuator is operatively associated with a dispensing pump connected to the bottle.

Still further features and associated advantages of the invention are made apparent from the following detailed description taken in conjunction with the accompanying FIGURE which is an elevational view, with parts in cross-section, of a pump dispenser and bottle constructed in accordance with the general teachings and principles of the invention.

DETAILED DESCRIPTION OF THE DRAWING

Referring now to the drawing, a blown plastic bottle 10 is illustrated in combination with a product dispensing pump 12. The bottle 10 comprises a hollow body portion 14 that includes a neck or neck portion 16. The bottle neck includes a horizontal step 20 which defines an abruptly reduced upper neck section 18.

A pump actuator is integral with bottle 10 and comprises a relatively thin, hollow member or handle-like extension 22 which at its base 24 is pivotally and flexibly joined to body portion 14. The actuator is spaced laterally from bottle neck 16 a distance such that the bottle neck assists to define a convenient back hand rest or hand rest surface 26, while the fingers of the hand extend forwardly to grip actuator 22 through a series of finger indentations 28. The upper end portion of the actuator is operably associated with dispensing pump 12.

The dispensing pump includes a pump housing 30 comprising a vertical cup 32 and an integral horizontal pump head section 34. Cup 32, which defines the upper area of back hand rest 26, rests on step 20 with the aid of a downwardly open, cylindrical groove 36 which seats over reduced neck section 18. A lip 38 of the reduced neck fits with a detent 40 in the profile of groove 36 to fasten the pump to bottle 10.

Pump head section 34 comprises a horizontal, stationary, cylindrical piston 42. Piston 42 terminates in a piston head 44 defining a vertical piston face 46. A pump barrel 48 is coaxial about piston 42. A radial space between the pump barrel and piston 42 defines a slideway 50 in which there is disposed a spring 52. A moveable piston cylinder 54 travels reversely in the slideway. A travel limiting stop 56 interferes with a lip 58 defined by piston cylinder 54, to define the extreme forward position of the piston cylinder. A latch 60 depends from the piston cylinder at a position outwardly of slideway 50, and is connected to actuator 22. An interference avoiding cutout 62 is defined at the underside of pump barrel 48 in alignment with latch 60.

Piston head 44 and piston cylinder 54 define an internal fluid displacement reservoir 72. A feed channel 74 is defined along the axis of piston 42, and communicates with the interior of bottle 10 through a dip tube 76, and vertical channel 78 defined in cup 32. Channel 74 discharges into reservoir 72 through a normally open ball check valve 80. The check valve seats with a valve seat 82 defined in piston face 46 with the aid of a small ball orientating projection 84 positioned at the base of the valve seat. A rubber boot 86, defining perforations 88, retains the ball check valve in near position to the valve seat. The boot includes a rim 90 which defines a thickened peripheral edge 92 that is depressed into a cylindrical groove 94 defined by piston head 44 rearwardly of valve seat 82. Rim 90 forms an "O-ring" seal between the piston and piston cylinder to prevent fluid seepage into slideway 50. The adjacent interface 96 between the piston cylinder and pump barrel 48 is non-sealed and provides communication between the atmosphere and the interior of bottle 10 through a bleed vent 98.

The piston cylinder terminates forwardly in a vertical partition 66 and socket 68. A combined nozzle and tip seal 70 is press-fitted in socket 68 and comprises a generally rigid circular plate 100 defining a spray orifice 102, and a raised nozzle valve seat 104 that projects backwardly. A resiliently deformable valving disk 106 is spaced rearwardly of plate 100 except at its central part 108 which is in seating contact with nozzle valve seat 104. An annular rim 110 joins plate 100 to the peripheral edge of valving disk 106, thereby defining an internal, annular nozzle chamber 112. Rim 110 defines a series of radially spaced, canted entry ports 114 which communicate between chamber 112 and the fluid displacement reservoir through a groove 116, also in rim 110, and registered openings 118, 120 defined in rim 110 and vertical partition 66, respectively. A rib 122 integral with the back of the valving disk, is joined in a groove 124 defined by partition 66 to produce a sealed space 125 at the back of the valving disk which is resistant to fluid migration. A spacer element 128 is offset from partition 66 into space 126 and limits the travel of valving disk 106.

OPERATION

To operate pump 12, actuator 22 is conveniently worked by the entire hand to permit powerful stroking of piston cylinder 54. The primer stroke of the pump depresses the piston cylinder into the pump housing permitting a near 100% sweeping or collapsing of fluid displacement reservoir 72. Release of the hand pressure automatically returns the piston cylinder to the extreme forward position by the outward bias of spring 52. Since the product discharge reservoir is swept to a minimal volume, return of the piston cylinder to the extreme forward position, with the assistance of the normally closed tip seal of spray orifice 102, creates a vacuum within the fluid displacement reservoir. The product is thereby displaced by atmospheric pressure into the evacuated fluid displacement reservoir with minimal priming effort. Further pumping action collapses the fluid discharge reservoir automatically seating ball check valve 80 with valve seat 82 to close the communication between the fluid discharge reservoir and feed channel 74. Consequently, the displaced fluid in the fluid displacement reservoir is urged under relatively high pressure into nozzle chamber 112 thereby unseating valving disk 106 from nozzle valve seat 104. Tangential swirling entry of the fluid under pressure through canted entry ports 114 into chamber 112 provides maximum agitation of the fluid to assist its break up into a mist or small particles, which is ultimately expelled through spray orifice 102. Upon completion of the positive stroke, the piston cylinder returns to the extreme forward position whereby the evacuation of the fluid displacement reservoir relieves the pressure within channel 112, reseating valve disk 106 with nozzle valve seat 104. The suction force simultaneously withdraws the ball check valve from valve seat 82, thereby refilling the fluid displacement reservoir with product. "Blown plastic bottle" as used herein refers to articles prepared most typically from an extruded or injected molded plastic parison or preform which is subsequently heated and expanded in a blow mold or which is blown in a free state. The term is not to be limited, of course, to the method of preparing the intermediate (or preform), and other known and satisfactory techniques may be so employed. Preferred plastics for bottle 10 comprise polyethylenes and polypropylenes, although other known plastics may be substituted which have sufficient resiliency to accept the flexing movement of activator 22 without cracking.

While the invention has been described to set forth the preferred mode, modifications obviously can be made while remaining within the principles of the disclosure and improvements herein described. For example, the configuration of the bottle is not critical. Designs for the actuator 22, of course, is matter of preference within the limits of the functional requirements described. Accordingly, it is intended only to limit the scope of the invention to that extent set out and distinguished in the appended claims.

What is claimed is:

1. The combination comprising an actuator integrally formed in a blown plastic bottle, the actuator having a first end flexibly and pivotally joined to the bottle, and a second end spaced from the bottle a distance such that the bottle is adapted to define a back hand rest while the fingers of the hand may be extended to grip the actuator, said actuator being operatively associated with a dispensing pump having connection to the bottle.

2. The combination comprising a blown plastic bottle, a pump connected to the bottle, a hollow member integral with the bottle and flexibly and pivotally joined thereto, said bottle defining a back hand rest, and a portion of the hollow member being spaced from the bottle a distance adapted for the fingers of the hand to grip the hollow member, said hollow member comprising an actuator for operating said pump.

* * * * *